United States Patent [19]

Kamm

[11] Patent Number: 4,601,696

[45] Date of Patent: Jul. 22, 1986

[54] CENTRIFUGE PROVIDED WITH A ROTOR IDENTIFICATION

[75] Inventor: Kevin L. Kamm, Marlow Bottom, England

[73] Assignee: Fisons plc, Ipswich, England

[21] Appl. No.: 648,681

[22] Filed: Sep. 10, 1984

[30] Foreign Application Priority Data

Sep. 17, 1983 [GB] United Kingdom ..... 8324912

[51] Int. Cl.[4] ..... B04B 15/00

[52] U.S. Cl. ..... 494/10; 318/316; 494/13

[58] Field of Search ..... 494/9, 8, 7, 1, 10, 494/13; 318/653, 315, 316, 317, 318; 210/360.1

[56] References Cited

U.S. PATENT DOCUMENTS 3,746,247 7/1973 Camilliere ..... 494/9

4,105,940 8/1978 Kuhnlein ..... 318/653

4,205,261 5/1980 Franklin ..... 494/10

4,269,132 5/1981 Hsu ..... 318/653

*Primary Examiner*—Robert W. Jenkins

*Attorney, Agent, or Firm*—Marshall, O'Toole, Gerstein, Murray & Bicknell

[57] ABSTRACT

There is described a centrifuge provided with a rotor identification system.

The rotor identification system includes a rotor (4) having a pair of detectable elements (11, 12), e.g. magnets, spaced by an angular separation characteristic of the rotor (4), detector means (3), e.g. a Hall effect transducer, positioned so as to interact with the detectable elements (11, 12) to generate a signal which is a function of the angular separation and means responsive (20) to the signal to identify the rotor (4).

8 Claims, 7 Drawing Figures

CENTRIFUGE PROVIDED WITH A ROTOR IDENTIFICATION

This invention relates to a centrifuge provided with a rotor indentification system.

Centrifuges comprising a housing enclosing a rotor coupled to a drive shaft and driven by a motor are well known. In particular, centrifuges operable with interchangeable rotors are widely used for separating mixtures for example, aqueous solutions containing biological materials. Such rotors frequently have widely different predetermined operating conditions, for example the maximum desirable operating speed (catalogue speed), the maximum speed above which the rotor will be dangerous and must not be permitted to operate (the overspeed), operating temperature, acceleration, etc. Conventionally, the rotor is identified by the person operating the centrifuge, who must then program the centrifuge manually according to the operating conditions of the rotor to be used.

Such programming has the disadvantage that it is susceptible to human error and erroneous programming can lead either to damage to the material being centrifuged or to the centrifuge itself.

We have now found a rotor identification system for use in centrifuges which overcomes this disadvantage.

According to the invention there is provided a centrifuge provided with a rotor identification system characterised in that the rotor identification system includes a rotor having a pair of detectable elements spaced by an angular separation characteristic of the rotor, detector means positioned so as to interact with the detectable elements to generate a signal which is a function of the angular separation and means responsive to the signal to identify the rotor.

The signal can be used to look up (eg electronically) and display the maximum gravitational force which will be applied to the material being centrifuged.

The means responsive to the signal preferably includes means for controlling an operating condition of the rotor. The means for controlling the operating condition may include a comparator operably linked to a reference means.

Examples of operating conditions of the rotor that may be identified and/or controlled include the temperature at which the rotor is to operate, the maximum acceleration and/or deceleration of the rotor, the catalogue speed and particularly the overspeed. Other operating conditions will be apparent to those skilled in the art.

The catalogue speed of the rotor will normally be below the overspeed by a sufficient margin to take account of the sum of all deviations which can occur in the determination of the overspeed. Such deviations can be related to minor variations in the positioning of the detectable elements, the speed of the rotor and/or the nature of the detector means. The overspeed should also be set at a sufficient margin below the actual or estimated speed at which danger will occur to take account of such deviation.

In controlling the catalogue speed and/or the overspeed the means responsive to the signal may be set to prevent further increases in the rotor speed, e.g. by applying brakes or by cutting off the power to the motor.

In controlling the acceleration the means responsive to the signal may be arranged to provide a continuous or preferably a stepped increase in power applied to the drive. Likewise in controlling the deceleration a continuous or preferably a stepped increase in the braking may be applied.

Conventionally centrifuges are refrigerated to avoid the energy which is imparted to the rotor and the surrounding gas heating the materials being centrifuged. However the amount of cooling necessary will depend on the particular rotor concerned and also the speed at which it is to be rotated. Also for each rotor there will be a necessary and different adjustment between the point within the centrifuge at which the temperature is measured (typically on the inside of the lid of the centrifuge) and the desired temperature in the sample being centrifuged. This adjustment is generally known as the temperature offset. For each type of rotor a calibration curve must be worked out empirically, and in the past the individual operating the centrifuge has had to make appropriate adjustments to the cooling controls to approximate to this curve. By means of the present invention the calibration curve can be preset within the electronics of the device and once the rotor is identified the appropriate cooling programme will be applied automatically.

The interaction of the detector means with the detectable elements may be a contact interaction, in which the detector means touches the detectable elements, or preferably a non-contact interaction, in which the detector means and detectable elements do not touch. Non-contact detectors that may be used include optical detectors, and preferably Hall effect detectors. We particularly prefer to use a linear Hall effect transducer, which provides a signal proportional to flux density as magnets pass close to it.

We prefer the two detectable elements on the rotor to be distinguishable one from the other so that the two sectors of the circle in which they are inscribed (i.e. n° and 360-n°) can be differentiated. By using distinguishable elements, e.g. magnets of opposing polarities, the elements can be situated at any desired angular separation, theoretically up to 360°, whereas if the points are indistinguishable theoretically only 180° of angular separation is available. In practice we prefer the two points to be separated by between about 60° and 300° thereby avoiding interaction of the two elements, e.g. when they are magnets. Thus if each angular degree of separation between the points represents a speed of 25 rpm the range between 60° and 300° gives a possible range of speeds between 1500 and 7500 rpm.

When distinguishable detectable elements are used, such that one element is associated with an on signal and the other element is associated with an off signal, the ratio of the time between the on and the off signal, and the off and the on signal respectively will be characteristic of the angular separation of the elements whatever the speed of rotation of the rotor. This ratio can be calculated by conventional electronic means and can be used (again via conventional electronic means e.g. an Eprom) to determine the various operating parameters of the centrifuge.

The speed of the rotor can also be measured by determining the time interval between the passage of the two elements past the detector, this time interval being inversely proportional to the speed. This time interval can be used, independently of the ratio of times mentioned immediately above, to control the catalogue speed, or preferably the overspeed, of the rotor.

Should one or both of the magnets fail, e.g. fall out of the rotor, either no or a constant or a distorted signal will be produced and this can be used to cause the centrifuge to fail safe.

The invention is described with respect to two elements, but clearly more than two elements, e.g. two pairs of magnets, can be used if desired.

According to the invention, there is also provided a centrifuge provided with a rotor identification and control system, characterised in that the system includes a rotor with a predetermined overspeed having a pair of magnets spaced by an angular separation which is proportional to the overspeed, a Hall effect transducer positioned so as to interact with the magnets to generate a rotor signal which is a function of the angular separation of the magnets, comparator means capable of comparing the rotor signal with a reference signal, the comparator means being operably connected to control means so as to prevent the rotor exceeding the overspeed.

According to the invention, there is further provided a rotor suitable for use in association with a centrifuge including detector means and response means characterised in that the rotor includes a pair of detectable elements, spaced by an angular separation characteristic of the rotor, the detector means being positioned so as to interact with the detectable elements to generate a signal which is a function of the angular separation, the response means being responsive to the signal to identify the rotor.

A preferred embodiment of the invention will now be described, by way of example, with reference to the accompanying drawings in which.

Figure 1:
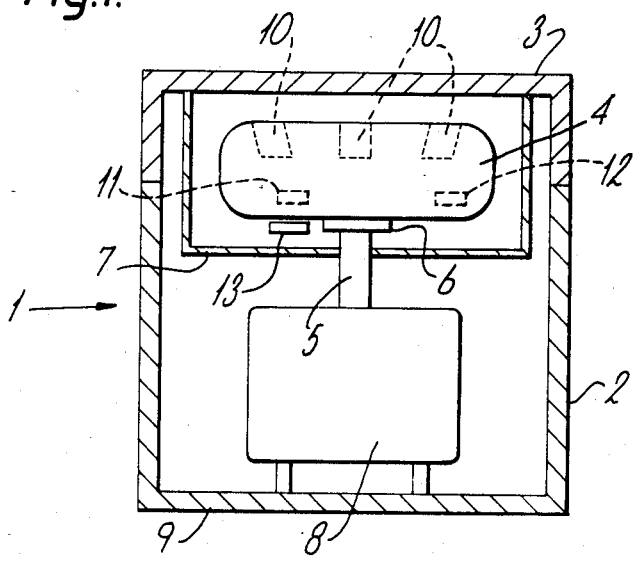
FIG. 1 is a schematic representation of a centrifuge provided with a rotor identification system, partially cut away to show the rotor.
Figure 2:
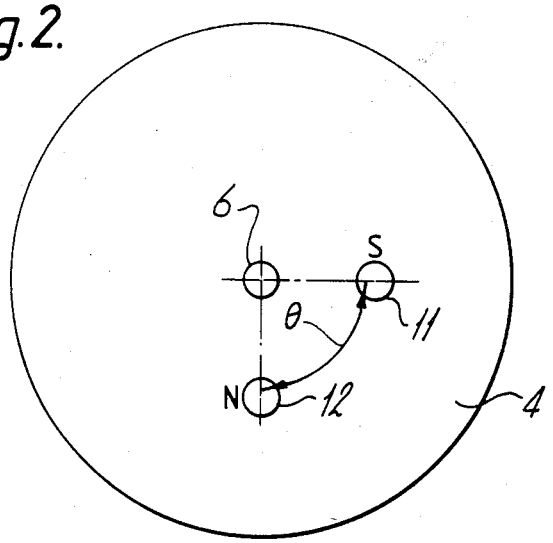
FIG. 2 is a plan view of the lower face of the rotor of the centrifuge of FIG. 1, showing the position of two magnets.
Figure 3A:
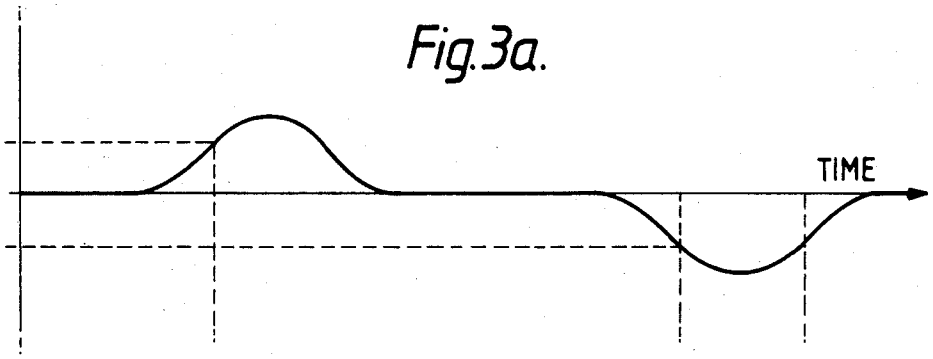
Figure 3B:
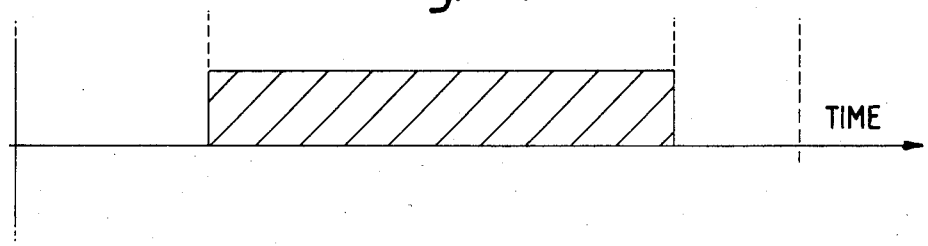
Figure 4:
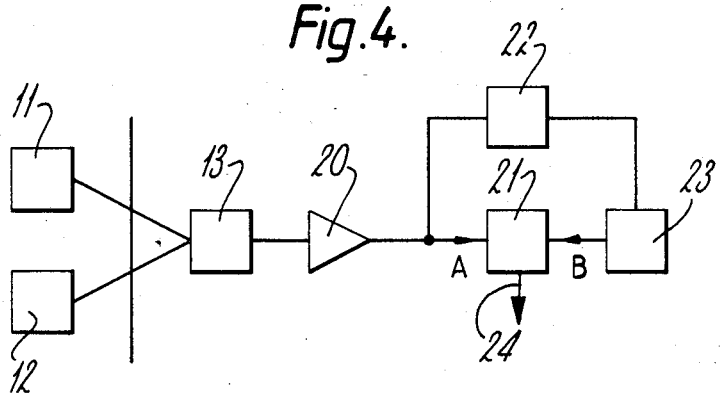

FIG. 3(*a*) and (*b*) show wave forms of signals generated by the magnets shown in FIG. 2 in terms of (a) flux and (b) transducer output signal;

FIG. 4 is a block diagram of an overspeed control circuit for the centrifuge of FIG. 1;

FIG. 5(*a*) and 5(*b*) are wave forms indicating the manner of operation of the circuit of FIG. 4.

Referring first to FIG. 1, a centrifuge 1, provided with a rotor identification system, comprises an outer housing 2 with a latchable lid 3. The housing 2 encloses a horizontal rotor 4 releasably coupled via a bearing mounting 6 to a drive shaft 5 and disposed above a refrigerated bowl 7. The drive shaft 5 is driven by a motor 8 mounted on a stationary base 9 within the housing 2. The rotor 4 is of generally conventional design and is provided with symmetrically distributed cups 10 in the upper face.

As is shown more clearly in FIG. 2, the rotor 4 has a pair of magnets 11, 12 fixed in holes drilled in the lower face of the rotor 4. The magnets 11, 12 are annularly disposed about the axis of rotation of the rotor 4 and are spaced by an angular separation $\theta$ characteristic of the rotor 4. The magnets 11, 12 have opposed poles, for example magnet 11 may have a south pole and magnet 12 a north pole pointing downwards, and act as detectable elements of the rotor identification system.

A linear Hall effect transducer 13, which acts as the detector means of the rotor identification system, is mounted on the bearing housing 6 below the rotor 5 and is positioned to co-operate with the magnets 11, 12. The transducer 13 is preferably spaced from 0.5 to 5 mm below the magnets 11, 12 and generates a signal upon each revolution of the rotor. The signal which is a function of the angular separation $\theta$, is illustrated diagrammatically in FIG. 3.

The signal generated by the transducer 13 actuates a means responsive to the signal to identify the rotor, which is in the form of an overspeed control circuit. As is shown in FIG. 4, the signal produced by the co-operation of transducer 13 with magnets 11 and 12 is fed to amplifier 20. The output of amplifier 20 feeds a pulse duration comparator 21 and a differentiating circuit 22, which latter circuit supplies a trigger pulse at the positive edge of the signal of FIG. 3*b* to trigger a pulse generator 23. When triggered, the pulse generator 23 supplies a reference pulse B of predetermined duration to the comparator 21.

A signal at the output 24 of the comparator is effective to cause disconnection of the supply to the motor 1 or otherwise to limit its speed.

Figure 5A:
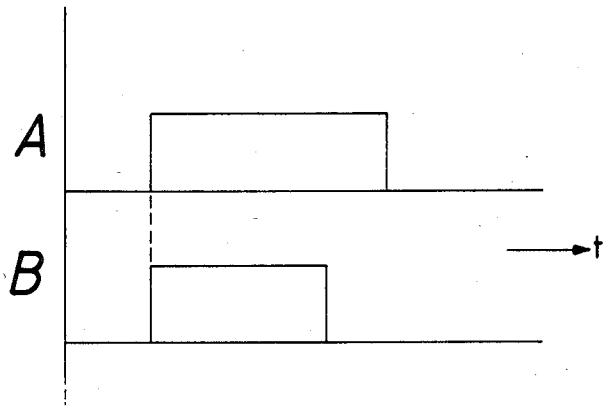
Figure 5B:
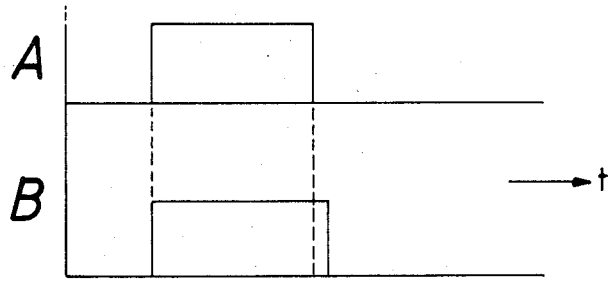

FIG. 5*a* illustrates the conditions at the comparator while the rotor is being run up to speed. At A is indicated the pulse fed to the comparator via the amplifier 20 and at B is represented the reference pulse B produced by the pulse generator. As indicated in this figure the pulse A has a longer duration than that of pulse B, indicating that the rotor speed is less than the permissible maximum speed. Under these conditions, there will be no signal at the output 24. When the rotor speed increases, the length of the pulse A falls until it reaches that of the pulse B. Any further increase of the rotor speed will further decrease the duration of the pulse A to to give the condition illustrated in FIG. 5*b*, whereupon the comparator will issue an output signal at 24 which indicates that the rotor speed has increased above the overspeed. As indicated, this output signal will cause deceleration of the motor 4, for example by positive braking or merely by disconnecting its supply.

I claim:

1. A centrifuge provided with a rotor identification system characterised in that the rotor identification system includes a rotor having a pair of detectable elements spaced by an angular separation characteristic of the rotor, detector means positioned so as to interact with the detectable elements to generate a signal which is a function of the angular separation, means responsive to the signal to identify the rotor, and wherein the detectable elements are distinguishable and the angular separation of the detectable elements is from 60° to 300°.

2. A centrifuge according to claim 1, wherein the means responsive to the signal includes means for controlling an operating condition of the rotor.

3. A centrifuge according to claim 2, wherein the means for controlling the operating condition includes a comparator operably linked to a reference means.

4. A centrifuge according to claim 1, wherein interaction of the detector means with the detectable element is a non-contact interaction.

5. A centrifuge according to claim 1, wherein the detector means comprises a Hall-effect transducer.

6. A centrifuge according to claim 1, wherein the rotor is interchangeably coupled to the centrifuge.

7. A centrifuge provided with a rotor identification and control system, characterised in that the system includes a rotor with a predetermined overspeed having a pair of magnets spaced by an angular separation which is proportional to the overspeed, a Hall effect transducer positioned so as to interact with the magnets to generate a rotor signal which is a function of the angular separation of the magnets, comparator means capable of comparing the rotor signal with a reference signal, the comparator means being operably connected to control means so as to prevent the rotor exceeding the overspeed.

8. A centrifuge provided with a rotor identification system characterised in that the identification system includes a rotor having a pair of detectable elements spaced by an angular separation of from 60° to 300° which is characteristic of the rotor, detector means, comprising a Hall-effect transducer positioned to interact with the detectable elements in a non-contact interaction to generate a signal which is a function of the angular separation, and means responsive to the signal to identify the rotor, including reference means and means for controlling an operating condition of the rotor, the means for controlling an operating condition of the rotor including a comparator operably coupled to the reference means.

* * * * *